US010618092B2

(12) United States Patent
Hashikawa et al.

(10) Patent No.: US 10,618,092 B2
(45) Date of Patent: Apr. 14, 2020

(54) SLIT BAND SHEET COILING-TENSION APPLYING DEVICE

(71) Applicant: JDC, inc., Nagasaki (JP)

(72) Inventors: Yoshito Hashikawa, Nagasaki (JP); Naoto Hashikawa, Nagasaki (JP)

(73) Assignee: JDC, inc., Nagasaki (JP)

( * ) Notice: Subject to any disclaimer, the term of this patent is extended or adjusted under 35 U.S.C. 154(b) by 0 days.

(21) Appl. No.: 15/560,128

(22) PCT Filed: Mar. 20, 2015

(86) PCT No.: PCT/JP2015/058570

§ 371 (c)(1),
(2) Date: Sep. 20, 2017

(87) PCT Pub. No.: WO2016/151701

PCT Pub. Date: Sep. 29, 2016

(65) Prior Publication Data

US 2018/0099321 A1 Apr. 12, 2018

(51) Int. Cl.
*B21C 47/00* (2006.01)
*B65H 23/10* (2006.01)
(Continued)

(52) U.S. Cl.
CPC ..... *B21C 47/006* (2013.01); *B21C 47/00* (2013.01); *B21C 47/003* (2013.01); *B21C 47/26* (2013.01);
(Continued)

(58) Field of Classification Search
CPC ..... B21C 47/006; B21C 47/003; B21C 47/26; B21C 47/345; B21C 47/3458;
(Continued)

(56) References Cited

U.S. PATENT DOCUMENTS 3,386,679 A * 6/1968 Foulon ..... B21B 39/08 226/109
3,481,523 A * 12/1969 Baringer ..... B21D 43/12 226/172
(Continued)

FOREIGN PATENT DOCUMENTS

JP 56-082755 A 7/1981
JP 63-11112 U 1/1988
(Continued)

*Primary Examiner* — Michael R Mansen
*Assistant Examiner* — Raveen J Dias
(74) *Attorney, Agent, or Firm* — Heedong Chae; Lucem, PC

(57) ABSTRACT

A device for applying coiling-tension to a slit band sheet (1) includes: an upper structure (3) that is disposed on the upper side of a band sheet (2) which has been passed through a slitter line and slitted; and a lower structure (4) that is disposed on the lower side of the band sheet (2). The upper structure (3) includes two cooling rolls (6) over which an upper belt (5) is stretched, and an upper pressing part (7) that is disposed between the cooling rolls (6). Further, the lower structure (4) includes two cooling roller (9) over which a lower belt (8) is stretched, and a lower pressing part (10) that is disposed between the cooling rolls (9).

7 Claims, 10 Drawing Sheets

(51) Int. Cl.

| | |
|---|---|
| ***B21C 47/34*** | (2006.01) |
| ***B65H 23/30*** | (2006.01) |
| ***B21C 47/26*** | (2006.01) |
| ***B65H 20/08*** | (2006.01) |
| ***B65H 20/06*** | (2006.01) |

(52) U.S. Cl.
CPC ..... *B21C 47/3458* (2013.01); *B65H 23/10* (2013.01); *B65H 23/105* (2013.01); *B65H 23/30* (2013.01); *B65H 20/06* (2013.01); *B65H 20/08* (2013.01)

(58) Field of Classification Search
CPC .... B65H 23/00; B65H 23/10; B65H 23/0324; B65H 23/038; B65H 23/18; B65H 23/26; B65H 23/30; B65H 23/32; B65H 20/06; B65H 20/08; B65H 20/02; B65H 20/36; B65H 20/40; B65H 27/00; B65H 2301/4148; B65H 2301/41482; B65H 2301/5144; B65H 2403/72
USPC ..... 242/419.5, 423, 423.1, 423.2
See application file for complete search history.

(56) References Cited

U.S. PATENT DOCUMENTS

| | | | | |
|---|---|---|---|---|
| 3,735,937 | A | 5/1973 | Plantard | |
| 5,265,817 | A * | 11/1993 | Gaudin | B21C 47/006 226/195 |
| 5,454,502 | A * | 10/1995 | Hashikawa | B21C 47/006 226/195 |
| 5,919,333 | A * | 7/1999 | Maltby | B65H 23/105 156/425 |
| 6,041,989 | A * | 3/2000 | Kikuchi | B65H 20/24 226/104 |
| 7,550,050 | B2 * | 6/2009 | Lewin | B21C 47/26 148/595 |
| 2004/0004148 | A1 * | 1/2004 | Hashikawa | B21C 47/003 242/419.8 |
| 2010/0084502 | A1 * | 4/2010 | Hashikawa | B21C 47/003 242/419.8 |
| 2012/0085853 | A1 * | 4/2012 | Hashikawa | B21C 47/006 242/419.4 |
| 2014/0102323 | A1 * | 4/2014 | Zagar | B65H 23/0258 101/212 |
| 2014/0260481 | A1 * | 9/2014 | Umlauf | B21D 1/05 72/164 |
| 2015/0316890 | A1 * | 11/2015 | Okuda | B65H 23/26 399/341 |

FOREIGN PATENT DOCUMENTS

| | | |
|---|---|---|
| JP | 2004-035174 A | 2/2004 |
| JP | 2012-081477 A | 4/2012 |

* cited by examiner (a)

-- Prior Art --

(b)

-- Prior Art --

SLIT BAND SHEET COILING-TENSION APPLYING DEVICE

TECHNICAL FIELD

The present invention relates to a device for applying coiling-tension to a slit band sheet and, more particularly, to a device for applying coiling-tension to a slit band sheet which is excellent in durability and improved in convenience in a slitter line of a metal band sheet.

BACKGROUND ART

In a so-called metal coil material processing line that includes a slitter line for a coiled long metal material, a tension device before winding after slitting is disposed therein. Examples of this tension device include a roll bridle, a belt-type tension device, and the like.

This tension device imparts a coiling tension before a winder to slit band sheets so that the band sheets are tightly and securely wound around a winding coil.

In addition, as the tension device, there is a coiling tension applying device of a multi-belt type tension system (refer to Patent Documents 1, 2, and 3) in which a metal band sheet is clamped from above and below the metal band sheet by a plurality of divided endless belts to impart a coiling tension by a frictional force of the backside of the belt.

In the device of this multi-belt type tension system, since the inside and outside of the belt have different coefficients of friction, uniform tension can be imparted to each band sheet. In addition, since the belt surface and the band sheet are rotated without sliding, scratches are not easily generated on the surface of the band sheet.

For example, Patent Document 1 discloses a coiling tension applying device 100 shown in FIG. 10A. In the device 100, a belt 102 is stretched by a pair of pulleys 101, and the belt 102 is pressed by a pushing plate 104 interlocked with a cylinder 103. Further, the plurality of pulleys 101 is provided side by side, and a plurality of belts 102 is stretched.

In the device 100, the pulley 101, the belt 102, and the pushing plate 104 are integrated and arranged so as to face each other vertically. Between the belts 102 facing each other, the slit band sheet 106 is conveyed to a winder which is not shown, and the belt 102 vertically compresses the band sheet 106 via the upper and lower pushing plates 104.

In addition, in the belt 102, the outer side of the belt is made of a material having a large coefficient of friction and the inner side of the belt is made of a material having a small coefficient of friction. When the band sheet 106 is brought into contact with the outer surface of the belt 102, the coefficient of friction on the outer side of the belt is large, so that when winding of the band sheet is started by the winder, the belt 102 moves with the band sheet 106 without slipping.

The pulley 101 is axially supported to be freely rotatable and the belt 102 is circulated. Between the inner surface of the belt 102 and the pushing plate 104, a coefficient of friction of the inner surface of the belt is small, so that slippage occurs and coiling tension in a direction opposite a conveying direction is applied to the band sheet 106 by the frictional force generated at the same time. Similarly, a device described in Patent Document 2 has a structure using a plurality of pulleys.

Patent Document 3 discloses a tension applying device 200 shown in FIG. 10B. The device 200 has a pressure applying body 202 that allows a belt 201 to be stretched on an outer peripheral surface thereof. The pressure applying body 202 includes two belt reversing portions 203 each having a cross section which is formed in an arc shape and a pressing portion 204 which presses the inner surface of the belt 201.

Protrusions are provided at regular intervals on the outer peripheral surface of the pressure applying body 202, and a plurality of belts 201 is stretched side by side. In the device 200, the pressure applying bodies 202 are arranged to face each other vertically. When a band sheet 205 which has been slit is conveyed to a winder between the facing belts 201, the belt 201 vertically compresses the band sheet 205 via the upper and lower pressing portions 204.

In addition, in the belt 201, the outer side of the belt is made of a material having a large coefficient of friction and the inner side of the belt is made of a material having a small coefficient of friction, in the same manner as in the device 100 of Patent Document 1. The belt 201 in contact with the band sheet 205 is circulated, and coiling tension is generated on the belt 201 in the same manner.

PRIOR ART DOCUMENTS

Patent Literatures

Patent Document 1: Japanese Patent Publication No. JP-A-56-82755
Patent Document 2: U.S. Pat. No. 3,735,937
Patent Document 3: Japanese Patent Publication No. 2004-35174

DETAILED DESCRIPTION OF THE INVENTION

Technical Problem

Here, in the tension devices that generate coiling tension by pressing the inner surface of the belt, including the devices of Patent Documents 1 to 3, generation of frictional heat becomes a problem. That is, since the pushing plate or the pressing portion moves by pressing the inner surface of the belt, the frictional heat is generated and most of the frictional heat is absorbed into the belt so that the belt becomes hot.

In the tension devices using the pulleys of Patent Documents 1 and 2, the heat of the belt that has become hot moves to a metal pulley, and the temperature rises to nearly 100° C. As a result, in a laminated portion and a bonded portion of the belt formed by laminating and bonding dissimilar materials, an adhesive is deteriorated by heat, which leads to damage to the belt and hinders the operation of a slitter line over an extended time.

In the tension device using the pulleys, it is structurally difficult to cool more than 200 pulleys through cooling water or the like, and there is no cooling structure for the pulleys.

Further, in the tension device of Patent Document 3, circulating cooling water is made to flow inside the pressure applying body so as to cool the belt. However, the cooling water tends to flow through the center portion of the cross section of the belt reversing portion or the pressing portion, and an amount of water flowing in the vicinity of the outer peripheral surface in contact with the belt is small, resulting in insufficient cooling efficiency.

In addition, since the belt reversing portion is not structured to rotate with respect to the belt that is circulated together with the above-mentioned pulley, the cooling efficiency is also deteriorated in this respect. As a result, even in the tension device of Patent Document 3, the frictional heat of the belt cannot be sufficiently removed so that the service life of the belt is shortened.

Further, in the tension device of Patent Document 3, the belt reversing portion and the pressing portion are integrated, and it is difficult to adjust the degree of tension of the belt. As the belt is used in the slitter line, the temperature rise and cooling of the belt are repeated by the frictional heat.

At this time, the length of the belt becomes longer due to thermal expansion together with the temperature rise of the belt, and a gap is created between the belt and the pressure applying body. Alternatively, the belt may contract due to the repetition of temperature rise and cooling thereof to tighten the pressure applying body, thereby causing defective rotation of the belt. As a result, a fatal problem of sticking slippage marks on the surface of the band sheet which has been slit also occurs.

Therefore, the present invention has been made in view of the above-mentioned problems, and an aspect of the present invention is to provide a device for applying coiling-tension to a slit band sheet which is excellent in durability and improved in convenience in a slitter line of a metal band sheet.

Technical Solution

In accordance with an aspect of the present invention, there is provided a device for applying coiling-tension to a slit band sheet including: a first stretched portion configured to have a first cooling roll that is configured to be freely rotatable while having a cylindrical shape and having a coolant inside; one or more first belts configured to be made of materials having different coefficients of friction, to be brought into contact with the first stretched portion at a side thereof with a smaller coefficient of friction, and to be stretched in a ring shape to be freely circulated; a first pressing portion configured to be brought into contact with the side of the one or more first belts with the smaller coefficient of friction by a predetermined length; a second stretched portion configured to be positioned to face the first stretched portion and to have a second cooling roll that is configured to be freely rotatable while having a cylindrical shape and having a coolant inside; one or more second belts configured to be made of materials having different coefficients of friction, to be brought into contact with the second stretched portion at a side thereof with a smaller coefficient of friction, and to be stretched in a ring shape to be freely circulated; and a second pressing portion configured to be positioned to face the first pressing portion and to be close to the first pressing portion while being brought into contact with the side of the one or more second belts with the smaller coefficient of friction by a predetermined length.

Here, there may be provided a structure in which the belts are stretched and maintained by the first stretched portion; the one or more first belts configured to be made of materials having different coefficients of friction, to be brought into contact with the first stretched portion at a side thereof with a smaller coefficient of friction, and to be stretched in a ring shape to be freely circulated; the second stretched portion; and the one or more second belts configured to be made of materials having different coefficients of friction, to be brought into contact with the second stretched portion at a side thereof with a smaller coefficient of friction, and to be stretched in a ring shape to be freely circulated. In addition, the belts may be circulated on an outer peripheral surface of each stretched portion.

Also, by the first pressing portion configured to be brought into contact with the side of the one or more first belts with the smaller coefficient of friction by a predetermined length and the second pressing portion configured to be positioned to face the first pressing portion and to be close to the first pressing portion while being brought into contact with the side of the one or more second belts with the smaller coefficient of friction by a predetermined length, each of the belts having been stretched may be pressed from the side with the small coefficient of friction, and the slit band to be conveyed may be clamped. That is, with a combination of the one or more first belts and the first pressing portion and a combination of the one or more second belts and the second pressing portion, a conveying path for the band sheet may be provided therebetween so that the second pressing portion is brought close to the first pressing portion, thereby clamping the band sheet between the respective belts. In addition, the predetermined length mentioned here refers to a length at which a contact pressure is generated such that a coiling tension can be sufficiently imparted to the band sheet which will be described later.

Also, by the one or more first belts configured to be made of materials having different coefficients of friction, to be brought into contact with the first stretched portion at a side thereof with a smaller coefficient of friction, and to be stretched in a ring shape to be freely circulated; the first pressing portion configured to be brought into contact with the side of the one or more first belts with the smaller coefficient of friction by a predetermined length; the one or more second belts configured to be made of materials having different coefficients of friction, to be brought into contact with the second stretched portion at a side thereof with a smaller coefficient of friction, and to be stretched in a ring shape to be freely circulated; and the second pressing portion configured to be positioned to face the first pressing portion and to be close to the first pressing portion while being brought into contact with the side of the one or more second belts with the smaller coefficient of friction by a predetermined length, a coiling tension may be imparted to the slit band sheet to be conveyed. That is, the side of each of the one or more first and second belts with the smaller coefficient of friction may be pressed by the first pressing portion and the second pressing portion, and the band sheet may be clamped from a surface on a side of each of belts with a large coefficient of friction. Next, the band sheet may be brought into contact with the side of the belts with the large coefficient of friction so that the belts may be circulated with the movement of the band sheet, and slippage or a frictional force may be generated between the side of the belts with the smaller coefficient of friction and the pressing portion and may become a coiling tension for the band sheet. In addition, the slit band sheet mentioned here indicates a metal material which has been slit in a known slitter line, has been processed into multiple band sheets in a state of a wide metal plate, and has been conveyed through the slitter line.

Also, by the first cooling roll that is configured to be freely rotatable while having a cylindrical shape and having a coolant inside and the second cooling roll that is configured to be freely rotatable while having a cylindrical shape and having a coolant inside, the heated belts may be cooled. That is, a temperature of the belts may be increased by frictional heat generated such that the pressing portion may press the side of the belts with the smaller coefficient of friction, but the inner side of the circulated belts and each cooling roll may be brought into contact with each other to efficiently remove the heat.

Also, by the first cooling roll configured to be freely rotatable and the second cooling roll configured to be freely rotatable, the heated belts may be efficiently cooled. That is, each cooling roll may be rotated with the circulation motion of the belts, so that heat moving to the cooling roll side may be dispersed and may be easily absorbed to the roll side.

Also, when the one or more first belts are juxtaposed with an interval therebetween in the first stretched portion and the one or more second belts are juxtaposed with an interval therebetween in the second stretched portion, a coiling tension may be imparted to the multiple band sheets by a combination of a plurality of belts.

Also, when the cooling water is circulated inside the first cooling roll and the second cooling roll, the heat of the belts may be removed by the cooling water. In addition, since the first cooling roll and the second cooling roll rotate in a direction of the circulation motion of each of belts so that a centrifugal force is exerted, the cooling water is easily moved to the vicinity of the outer surface of each cooling roll, thereby further increasing the cooling efficiency.

Also, when the thickness of the outer surface layer in each of the first cooling roll and the second cooling roll is 3 mm or less, the heat of each of heated belts is easily moved from the outer surface of each cooling roll to the inside of the cooling roll, thereby further increasing the cooling efficiency.

Also, when each of the first cooling roll and the second cooling roll has an inner cylinder portion on a side of a center shaft and an outer cylinder portion substantially surrounding the inner cylinder portion and the cooling water is circulated between the inner cylinder portion and the outer cylinder portion, the cooling water may flow in the vicinity of the outer cylinder portion. That is, it is easier to remove the heat of each of the heated belts from the cooling roll. Further, the circulation efficiency of water inside the cooling roll may be increased, thereby further increasing the cooling efficiency.

Also, when the first cooling roll and the second cooling roll are disposed in a direction in which a slit band sheet to be conveyed through a slitter line advances, the cooling efficiency may be further increased. That is, the belts that has been pressed by the pressing portion may be circulated and be brought into contact with each cooling roll immediately.

Also, when the first cooling roll is disposed at both ends of the first stretched portion and the second cooling roll is disposed at both ends of the second stretched portion, the belts may be stretched in the cooling roll. That is, the first stretched portion and the second stretched portion may be constituted of cooling rolls. Further, the belts are brought into contact with the two cooling rolls, thereby further increasing the cooling efficiency.

Also, when the first stretched portion is provided with the first cooling roll disposed at one end thereof and has one or more first belts reversing portion having a semicylindrical cross-section in a longitudinal direction at the other end thereof and the second stretched portion is provided with the second cooling roll disposed at one end thereof and has one or more second belts reversing portion having a semicylindrical cross-section in a longitudinal direction at the other end thereof, the belts may be stretched by the cooling roll and the belt reversing portion. That is, the belts may be maintained in a substantially elliptical state by the cooling roll and the belt reversing portion.

Also, when the first cooling roll is positionally changeable in a direction in which the one or more first belts are stretched or relaxed and the second cooling roll is positionally changeable in a direction in which the one or more second belts are stretched or relaxed, the belts may be stretched to correspond to the degree of extension of the belts. That is, a degree in which the belts are stretched may be adjusted in accordance with the extension and contraction of the belts with a temperature change.

Advantageous Effects

A device for applying coiling-tension to a slit band sheet according to the present invention may be excellent in durability and improved in convenience in a slitter line of a metal band sheet.

MODE FOR CARRYING OUT THE INVENTION

Hereinafter, embodiments of the present invention will be described with reference to the drawings to facilitate understanding of the present invention.

Figure 1:
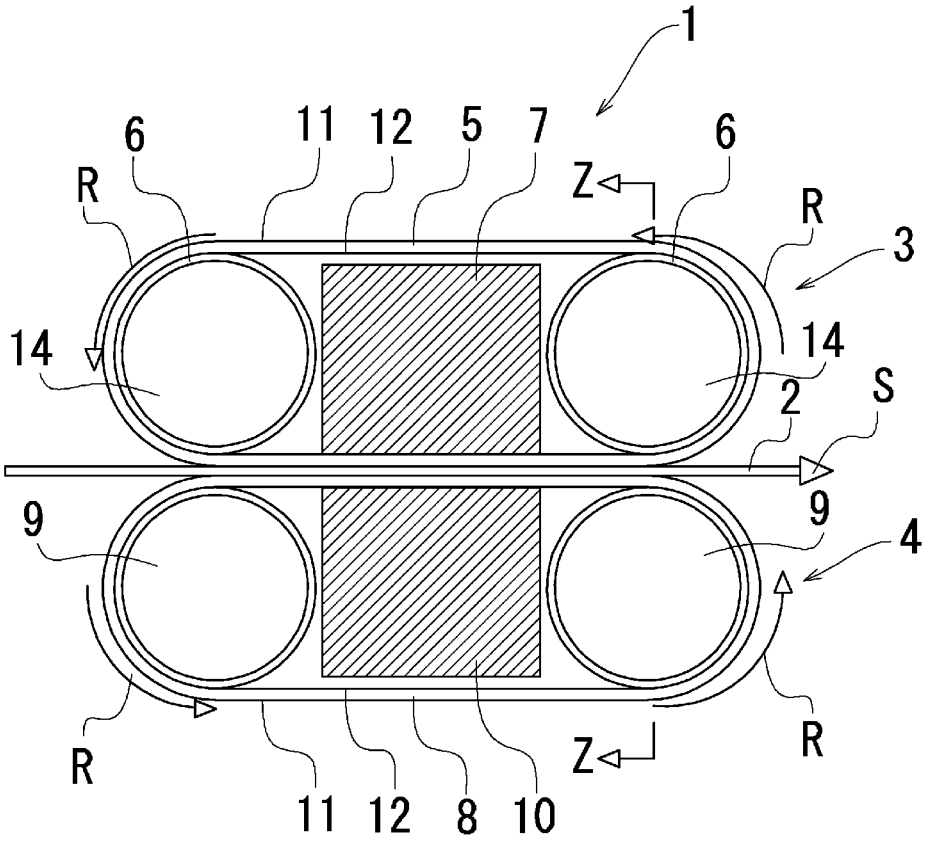
FIG. 1 is a schematic view showing a structure of a first embodiment of the present invention.
Figure 2:
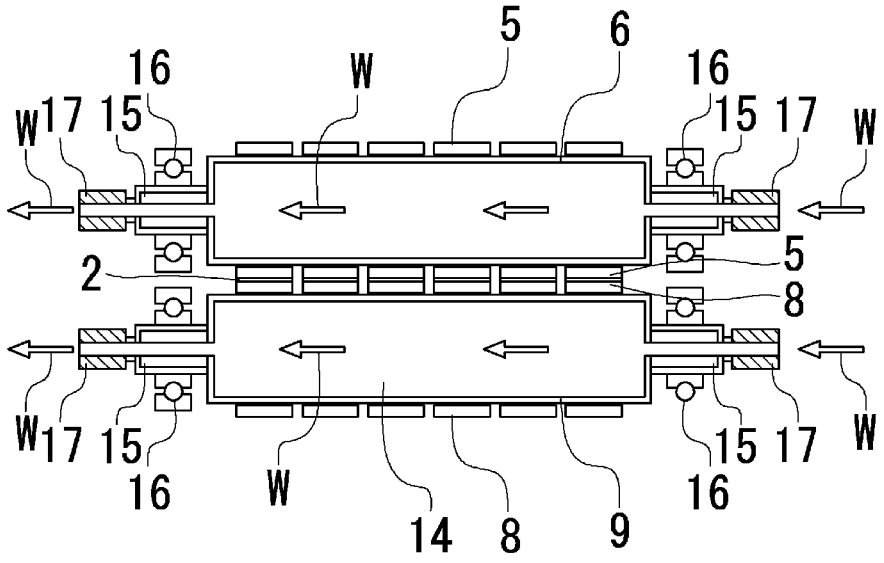
FIG. 2 is a schematic cross-sectional view in a direction of an arrow Z of FIG. 1.

FIG. 1 is a schematic view showing a structure of a first embodiment of the present invention, and FIG. 2 is a schematic cross-sectional view in a direction of an arrow Z of FIG. 1. In addition, the embodiment of the present invention is not limited to the following contents, but is merely an example. In addition, the drawings shown in FIGS. 1 to 9 show a schematic structure for explanation, and do not limit the size and scale of the structure in the present invention.

First Embodiment

As shown in FIG. 1, a coiling tension applying device 1 according to a first embodiment of the present invention includes an upper structure 3 that is disposed above a band sheet 2 which has been passed through a slitter line and slit, and a lower structure 4 that is disposed below the band sheet 2.

The band sheet 2 which has been slit means that a wide metal plate is slit into multiple band sheets in a known slitter line. Although not shown, the coiling tension applying device 1 is disposed in front of a winder of the band sheet in the known slitter line and applies a coiling tension to the band sheet 2.

The upper structure 3 has two cooling rolls 6 that allow one or more upper belts 5 to be stretched and an upper pressing portion 7 disposed between the cooling rolls 6. In addition, the lower structure 4 has two cooling rolls 9 that allow one or more lower belts 8 to be stretched and a lower pressing portion 10 disposed between the cooling rolls 9.

The one or more upper belts 5 is stretched in an elliptical shape in a cross section thereof by the cooling roll 6 and can be circulated on outer circumferential surfaces of the cooling roll 6. The cooling roll 6 and the upper pressing portion 7 have a longitudinal direction perpendicular to a direction in which the band sheet 2 is passed between the upper structure 3 and the lower structure 4, and a plurality of upper belts 5 is arranged side by side at regular intervals on outer peripheral surfaces of the cooling roll 6 and the upper pressing portion 7. In addition, the one or more lower belts 8, the cooling roll 9, and the lower pressing portion 10 also have the same structure as the upper structure.

Protrusions which are not shown are provided on the outer circumferential surface of the cooling roll 6 and between the upper belts 5 so as to define an interval between the adjacent upper belts 5. Similarly, protrusions are provided on the cooling roll 9 to define the position of the one or more lower belts 8.

The upper structure 3 and the lower structure 4 vertically provided as a pair act on the band sheet 2 that is passed therebetween. Further, a shaft provided at an end portion of each of the cooling roll 6 and the upper pressing portion 7 is connected to a connecting bearing, and the upper structure 3 has an integrated structure.

Similarly, in the lower structure 4, a shaft of the cooling roll 9 and the lower pressing portion 10 are connected to a connecting bearing to form an integrated structure. The connecting bearing of the upper structure 3 and the connecting bearing of the lower structure 4 are connected to and supported by a stand provided on a bottom surface on which the device is installed.

In addition, the upper structure 3 is connected to an elevating rod and a hydraulic cylinder so as to be lifted and lowered. A distance between the upper structure 3 and the lower structure 4 is changed by the hydraulic cylinder and the band sheet 2 conveyed therebetween is clamped.

The one or more upper belts 5 and the one or more lower belts 8 are interlocked with the upper pressing portion 7 and the lower pressing portion 10 to apply coiling tension to the band sheet 2. The one or more upper belts 5 and the one or more lower belts 8 are brought into contact with the band sheet 2 on outer surfaces 11 thereof, and at the same time are brought into contact with each pressing portion and each cooling roll on inner surfaces 12 thereof.

Each of the upper pressing portion 7 and the lower pressing portion 10 has a rectangular cross section or a substantially square cross section, and is brought into contact with the inner surface 12 of each belt by a predetermined length in the direction in which the band sheet 2 is passed between the upper structure 3 and the lower structure 4. In addition, the upper pressing portion 7 and the lower pressing portion 10 press the inner surface 12 of each belt in a direction in which a distance between the upper and lower pressing portions is reduced by the lifting and lowering of the hydraulic cylinder, that is, a direction in which the band sheet 2 is clamped. Further, by adjusting a pressing force of the hydraulic cylinder, the coiling tension of the band sheet can be adjusted.

Each of the one or more upper belts 5 and the one or more lower belts 8 has an outer side and an inner side made of different materials from each other, and a coefficient of friction of the material of the outer side is larger than that of the material of the inner side.

More specifically, the inner surface 12 of each belt is formed of woven fabric of synthetic fibers such as polyester, vinylon, nylon, and the like. A lubricant for reducing the coefficient of friction can be impregnated in the interstices of the woven fabric and in recessed portions of meshes thereof.

In addition, the outer surface 11 of each belt is made of a relatively thin flexible material having appropriate compressive elasticity, for example, rubber or synthetic resin, so as not to stick pressure marks on the surface of the band sheet.

Here, it is sufficient that the material of the inner surface 12 of each belt has a smaller coefficient of friction than that of the outer surface, and the material of the inner surface 12 is not limited. However, it is preferable that the inner surface 12 of each belt be formed of woven fabric of synthetic fibers such as polyester, vinylon, nylon, and the like in that the woven fabric of synthetic fibers is easy to be obtained, has flexibility, and can easily adjust the coefficient of friction to a constant value.

In addition, it is sufficient that the material of the outer surface 11 of each belt has a larger coefficient of friction than that of the inner surface, and the material of the outer surface 11 is not limited. However, it is preferable that the outer surface 11 of each belt be made of rubber, synthetic resin, or the like in that the rubber or synthetic resin has a high coefficient of friction, flexibility, and excellent durability.

When the outer surface 11 of each belt is brought into contact with the surface of the belt 2 that is passed between the upper structure 3 and the lower structure 4, the coefficient of friction of the surface is large, so that each belt moves while contacting the band sheet 2. As a result, the one or more upper belts 5 and the one or more lower belts 8 are circulated in a state where they are stretched on the cooling rolls. In FIG. 1, a direction in which the band sheet 2 is passed between the upper structure 3 and the lower structure 4 is indicated by an arrow S, and a direction in which each belt is circulated is indicated by an arrow R.

The inner surface 12 of each belt is brought into contact with outer peripheral surfaces of each cooling roll and each pressing portion while being circulated. At this time, as described above, the upper pressing portion 7 and the lower pressing portion 10 are brought into contact with the inner surface 12 of the belt, and press the inner surface 12 of each belt in the direction in which the distance between the upper and lower pressing portions is reduced by the hydraulic cylinder, that is, the direction in which the band sheet 2 is clamped.

When the inner surfaces 12 of the one or more upper belts 5 and the one or more lower belts 8 are brought into contact with the upper pressing portion 7 and the lower pressing portion 10, slippage occurs and a frictional force is generated due to a small coefficient of friction of the inner surface 12. This frictional force acts in a direction opposite the direction in which the band sheet 2 is passed between the upper structure 3 and the lower structure 4, and coiling tension depending on the plate thickness and material of the band sheet may be obtained by adjusting the pressing force of the hydraulic cylinder. Further, the coiling tension is a frictional force generated in the belt and the pressing portion, and frictional heat is generated. This frictional heat is absorbed into the belt, and the temperature of the inner surface of the belt increases.

In addition, the cooling roll 6 and the cooling roll 9 rotate with the circulation motion of each belt. A rotary shaft of each of the cooling roll 6 and the cooling roll 9 is axially supported by a ball bearing with a low frictional resistance, so that they have little influence on the circulation motion of each belt.

The cooling roll 6 and the cooling roll 9 are brought into contact with the inner surface 12 of the belt while rotating with the circulation motion of each belt. The cooling roll 6 and the cooling roll 9 are formed of a metal having excellent thermal conductivity and having an outer layer of about 5 to 10 mm in plate thickness, for example, copper.

In addition, in the cooling roll 6 and the cooling roll 9, the inside of the outer layer is formed as a cavity, and cooling water 14 flows in the cavity. The inner surface 12 of the one or more heated upper belts 5 is brought into contact with the outer layer of the cooling roll 6 so that the heat is transferred from the outer layer to the cooling water 14 inside the cooling roll 6 to cool the one or more upper belts 5.

Similarly, the one or more heated lower belts 8 is also brought into contact with the outer layer of the cooling roll 9 so that the heat is transferred to the cooling water 14 to cool the one or more lower belts 8.

Here, the cooling roll 6 and the cooling roll 9 are not necessarily required to have the outer layer made of copper having a plate thickness of about 5 to 10 mm. However, it is preferable that the outer layers of the cooling roll 6 and the cooling roll 9 be made of copper having a plate thickness of about 5 to 10 mm in that the movement of heat from the surface of the cooling roll to the cooling water inside the cooling roll becomes faster by reducing the plate thickness of the outer layer to less than 10 mm and constant durability can be applied. Further, the materials of the outer layers of the cooling roll 6 and the cooling roll 9 are not limited to copper, but it is sufficient that they have durability and excellent heat transfer efficiency. For example, the outer layers of the cooling roll 6 and the cooling roll 9 may be made of aluminum or steel.

As shown in FIG. 2, a rotary shaft 15 is provided at both ends of the cooling roll 6 and the cooling roll 9 and is connected to a ball bearing 16 and a rotary joint 17.

In addition, an inner piping structure for allowing the cooling water 14 to flow therein is formed inside the rotary shaft 15, the bearing 16, and the rotary joint 17 so that the cooling water 14 flows from one end side of each cooling roll to the other end side thereof. The piping structure is connected to a water pump or the like, and water is supplied thereto. An arrow W of FIG. 2 indicates a direction in which the cooling water 14 flows.

In addition, as described above, the plurality of upper belts 5 is arranged side by side on the outer circumferential surface of the cooling roll 6. Further, the plurality of lower belts 8 is likewise arranged on the outer circumferential surface of the cooling roll 9 in the same manner. The one or more upper belts 5 and the one or more lower belts 8 vertically face each other as a pair, and are connected to the surface of the band sheet 2 which has been slit to a predetermined width.

As described above, in the first embodiment of the present invention, the heated belt is brought into contact with the respective cooling rolls provided in the upper structure 3 and the lower structure 4, thereby efficiently removing heat.

In addition, since the cooling roll 6 and the cooling roll 9 are axially supported to be freely rotatable without interfering with the circulation motion of the one or more upper belts 5 and the one or more lower belts 8, it is difficult for heat to stay in the cooling roll itself so that the cooling efficiency is further increased.

Second Embodiment

Hereinafter, a second embodiment of the present invention will be described.

Figure 3:
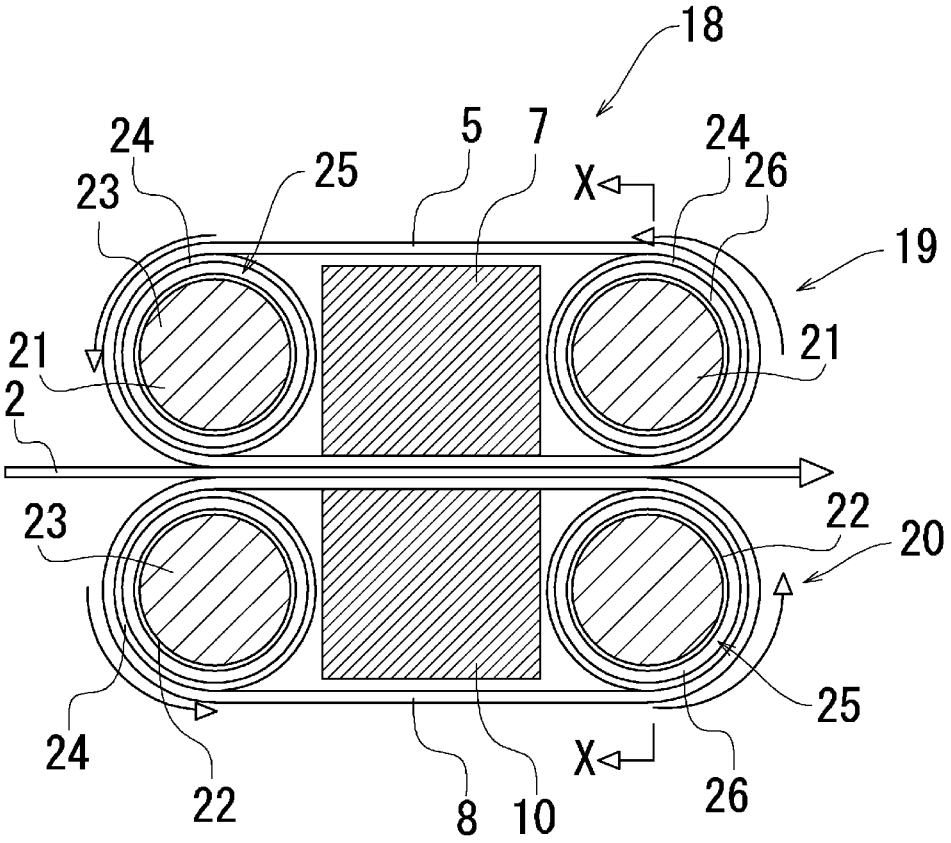
FIG. 3 is a schematic view showing a structure of a second embodiment of the present invention.
Figure 4:
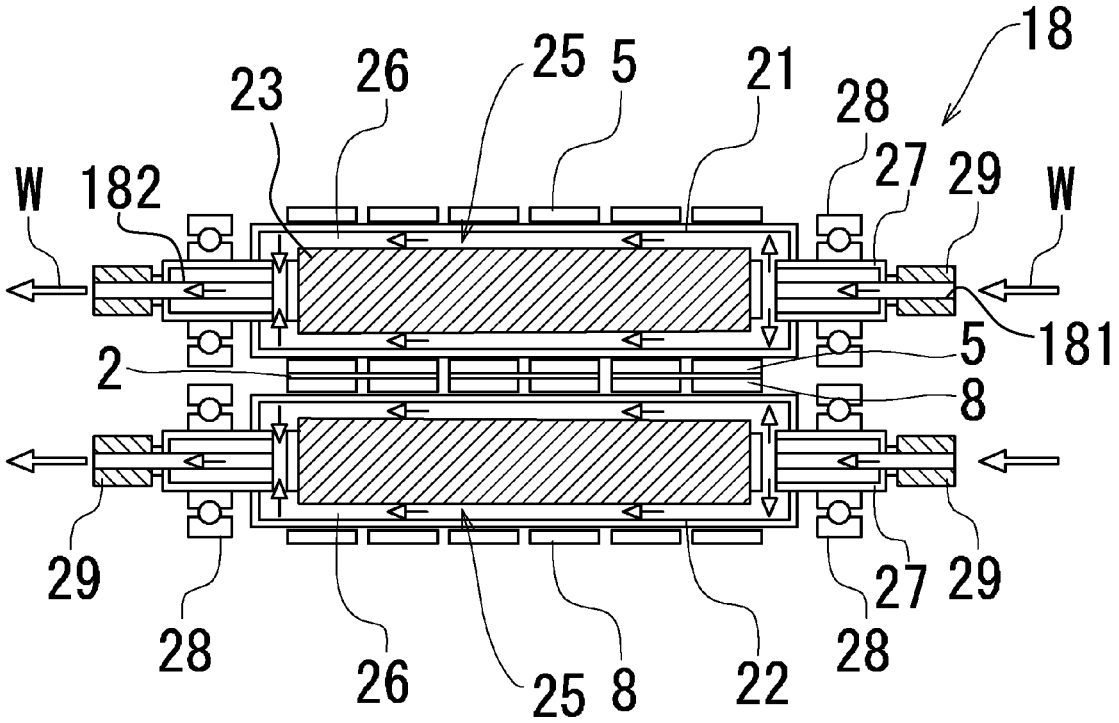
FIG. 4 is a schematic cross-sectional view in a direction of an arrow X of FIG. 3.

FIG. 3 is a schematic view showing a structure of the second embodiment of the present invention, and FIG. 4 is a schematic cross-sectional view in a direction of an arrow X of FIG. 3.

In FIG. 3, a coiling tension applying device 18 according to the second embodiment of the present invention is described. The coiling tension applying device 18 includes an upper structure 19 disposed above the band sheet 2 and a lower structure 20 disposed below the band sheet 2. Further, in FIGS. 3 and 4, the same components as the above-described first embodiment of the present invention are denoted by the same reference numerals and description thereof will be omitted. Hereinafter, components of the second embodiment different from the components of the first embodiment will be described.

The upper structure 19 has two cooling rolls 21 that allow the one or more upper belts 5 to be stretched and the upper pressing portion 7 disposed between the cooling rolls 21. In addition, the lower structure 20 has two cooling rolls 22 that allow the one or more lower belts 8 to be stretched and the lower pressing portion 10 disposed between the cooling rolls 22.

In the coiling tension applying device 18, the structures of the cooling roll 21 and the cooling roll 22 are different from those of the cooling roll 6 and the cooling roll 9 described above.

The cooling roll 21 and the cooling roll 22 have a double cylindrical structure composed of an inner cylinder portion 23 integrated with a rotary shaft and an outer cylinder portion 24 formed on the outer side of the inner cylinder portion 23. Further, a space 25 is formed between the inner cylinder portion 23 and the outer cylinder portion 24, and cooling water 26 flows into this space. The outer cylinder portion 24 is made of steel having a plate thickness of 1 to 3 mm so as to efficiently transfer the heat of the belt to the cooling water.

In addition, the cross-sectional area of the space 25, as shown in FIG. 3, is about 2.5 to 5.0 times the cross-sectional area of a pipe 181, as shown in FIG. 4, on a side of the cooling water 26 entering each cooling roll; and the cross-sectional area of the space 25 is about 2.5 to 5.0 times the cross-sectional area of a pipe 182 on an outlet side of the water from each cooling roll.

Here, the outer cylinder portion 24 is not necessarily required to be made of steel having a plate thickness of 1 to 3 mm. However, it is preferable that the outer cylinder portion 24 be made of steel having a plate thickness of 1 to 3 mm in that the movement of heat from the surface of the cooling roll to the cooling water inside the cooling roll becomes faster by further reducing the plate thickness of the outer cylinder portion 24 and constant durability can be ensured. Further, the material of the outer cylinder portion 24 is not limited to steel, but it is sufficient that the outer cylinder portion 24 has durability and excellent heat transfer efficiency and a metal or the like satisfying the conditions can be employed.

In addition, the cross-sectional area of the space 25 is not necessarily required to be 2.5 to 5.0 times the cross-sectional area of the pipe 181 on the side of the cooling water 26 entering each cooling roll and the cross-sectional area of the pipe 182 on the outlet side of the water from each cooling roll. However, it is preferable that the cross-sectional area of the space 25 be 2.5 to 5.0 times the cross-sectional area of the pipe 181 on the side of the cooling water 26 entering each cooling roll and the cross-sectional area of the space 25 be 2.5 to 5.0 times the cross-sectional area of the pipe 182 on the outlet side of the water from each cooling roll in that an amount of flowing cooling water is increased, the heat removal efficiency is improved, and the flow rate of the cooling water does not become too slow so that the circulation efficiency is increased.

Meanwhile, when the cross-sectional area of the space 25 is smaller than 2.5 times the cross-sectional area of the pipe on the side of the cooling water 26 entering each cooling roll and the cross-sectional area of the pipe 181 on the outlet side of the water from each cooling roll, a flow rate in the space 25 for cooling water becomes fast and a residence time of the cooling water 26 becomes short so that the heat quantity to be obtained may be reduced and the heat removal efficiency may be deteriorated. In addition, when the cross-sectional area of the space 25 is larger than 5.0 times the cross-sectional area of the pipe 181 on the side of the cooling water 26 entering each cooling roll and the cross-sectional area of the pipe 182 on the outlet side of the water from each cooling roll, the flow rate of the cooling water 26 becomes slow, the residence time of the cooling water 26 in the space 25 becomes long, and a temperature of the cooling water 26 rises excessively during this time so that the heat removal efficiency may be deteriorated.

As shown in FIG. 4, each of the cooling roll 21 and the cooling roll 22 is provided with a rotary shaft 27 and the rotary shaft 27 is connected to a ball bearing 28 and a rotary joint 29.

In addition, a piping structure for allowing the cooling water 26 to flow therein is formed inside the rotary shaft 27, the bearing 28, and the rotary joint 29 so that the cooling water 26 flows from one end side of each cooling roll to the other end side thereof. Inside the cooling roll 21 and the cooling roll 22, the cooling water 26 flows in the vicinity of the outer cylinder portion 24 of the roll. During the operation of a slitter line, the belt is pulled and rotated by the band sheet and the cooling roll is rotated, so that the cooling water 26 in the roll may enable efficient heat transfer by closely contacting the inner wall of the roll by a centrifugal force. An arrow W in FIG. 4 indicates a direction in which the cooling water 26 flows.

As described above, in the second embodiment of the present invention, the heated belt is brought into contact with the respective cooling rolls provided in the upper structure 19 and the lower structure 20 to efficiently remove heat.

In addition, the cooling roll 21 and the cooling roll 22 adopt a double cylindrical structure so that the cooling water 26 flows closer to an outer circumferential surface of the outer cylinder portion 24 with which each belt is brought into contact, thereby further increasing the cooling efficiency. Further, since the space 25 in which the cooling water 26 flows becomes small, an amount of the cooling water can be reduced and efficient heat removal can be realized.

In addition, since the outer cylinder portion 24 has a thin plate thickness of 1 to 3 mm, the heat from the inner surface 12 of each belt is easy to be transferred and the outer cylinder portion 24 has a structure having a high thermal conductivity to the cooling water 26 therein. Further, since each of the cooling roll 21 and the cooling roll 22 has the inner cylinder portion 25 integrated with the rotary shaft 27, the thickness of the outer cylinder portion 24 can be made thinner while achieving durability of the cooling roll 21 and the cooling roll 22 that can withstand a continuous operation.

Third Embodiment

Hereinafter, a third embodiment of the present invention will be described.

Figure 5:
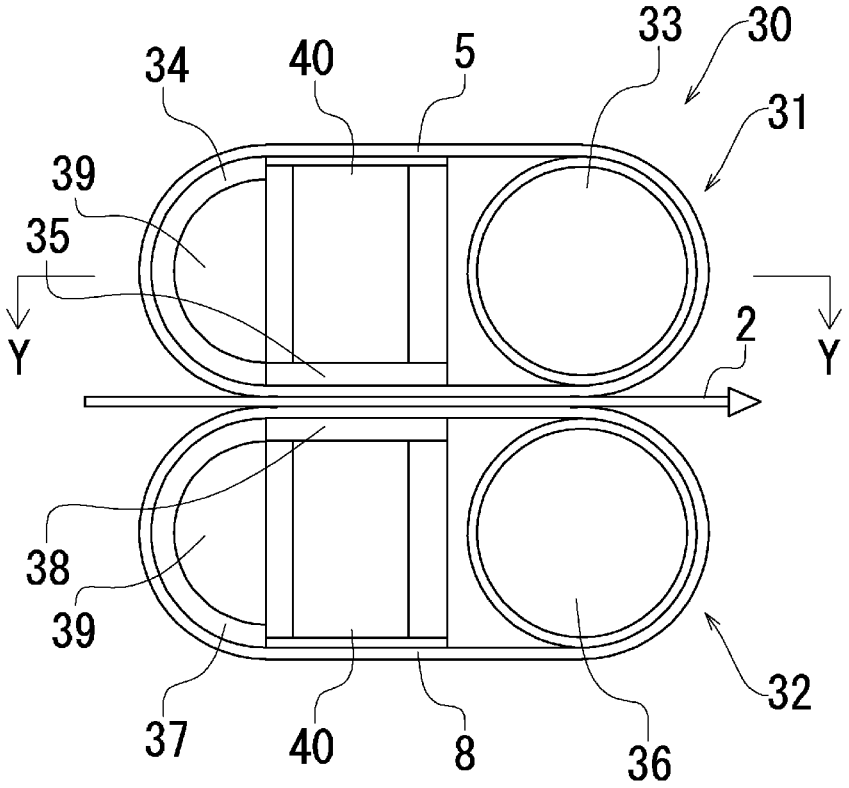
FIG. 5 is a schematic view showing a structure of a third embodiment of the present invention.

FIG. 5 is a schematic view showing a structure of a third embodiment of the present invention.

In FIG. 5, a coiling tension applying device 30 according to the third embodiment of the present invention is described. The coiling tension applying device 30 includes an upper structure 31 disposed above the band sheet 2 and a lower structure 32 disposed below the band sheet 2. Further, in FIG. 5, the same components as the above-described first embodiment of the present invention are denoted by the same reference numerals and description thereof will be omitted. Hereinafter, components of the third embodiment different from the components of the first embodiment will be described.

The upper structure 31 has a cooling roll 33 that allows the one or more upper belts 5 to be stretched in an elliptical shape and a fixed semicylinder 34. Further, the upper structure 31 has an upper pressing portion 35 adjacent to the fixed semicylinder 34.

In addition, the lower structure 32 has a cooling roll 36 that allows the one or more lower belts 8 to be stretched and a fixed semicylinder 37. Further, the lower structure 32 has a lower pressing portion 38 adjacent to the fixed semicylinder 37.

The one or more upper belts 5 may be circulated on outer peripheral surfaces of the cooling roll 33 and the fixed semicylinder 34. The cooling roll 33, the fixed semicylinder 34, and the upper pressing portion 35 have a longitudinal direction in a direction perpendicular to a direction in which the band sheet 2 is passed between the upper structure 31 and the lower structure 32 and a plurality of upper belts 5 is arranged side by side at regular intervals on outer peripheral surfaces of the cooling roll 33, the fixed semicylinder 34, and the upper pressing portion 35. In addition, the one or more lower belts 8, the cooling roll 36, the fixed semicylinder 37, and the lower pressing portion 38 have the same structure as the upper structure 31.

Protrusions which are not shown are provided on the outer peripheral surface of the fixed semicylinder 34 and between the upper belts 5 so as to define an interval between the adjacent upper belts 5. Similarly, protrusions are provided on the fixed semicylinder 37 to define the position of the one or more lower belts 8.

The upper structure 31 and the lower structure 32 vertically provided as a pair act on the band sheet 2 that is passed therebetween. Further, a shaft provided at an end portion of each of the cooling roll 33, the fixed semicylinder 34, and the upper pressing portion 35 is connected to a connecting bearing, and the upper structure 31 has an integrated structure.

Similarly, in the lower structure 32, a shaft of each of the cooling roll 36, the fixed semicylinder 37, and the lower pressing portion 38 is connected to a connecting bearing to form an integrated structure. The connecting bearing of the upper structure 31 and the connecting bearing of the lower structure 32 are connected to and supported by a stand provided on a bottom surface on which the device is installed.

In addition, the upper structure 31 is connected to an elevating rod and a hydraulic cylinder so as to be lifted and lowered. A distance between the upper structure 31 and the lower structure 32 is changed by the hydraulic cylinder and the band sheet 2 conveyed therebetween is clamped.

A cavity is formed inside the cooling roll 33 and the cooling roll 36 to allow the cooling water to flow therein.

The fixed semicylinder 34 and the fixed semicylinder 37 allow the belt to be stretched in contact with the inner surface of each belt on arc-shaped outer circumferential surfaces thereof. In addition, the inside of each of the fixed semicylinder 34 and the fixed semicylinder 37 is formed as a cavity and the cooling water 39 flows in the cavity, so that the belt contacting the outer circumferential surfaces of the fixed semicylinder 34 and the fixed semicylinder 37 is cooled.

The upper pressing portion 35 and the lower pressing portion 38 are disposed in connection with the adjacent fixed semicylinder, so that the upper structure 31 and the lower structure 32 have strength. In addition, the inside of each of the upper pressing portion 35 and the lower pressing portion 38 is formed as a cavity and cooling water 40 flows in the cavity, so that the belt contacting the outer peripheral surfaces of the upper pressing portion 35 and the lower pressing portion 38 is cooled.

As described above, in the third embodiment of the present invention, the heated belt is brought into contact with the respective cooling rolls provided in the upper structure 31 and the lower structure 32 to efficiently remove heat.

Figure 6:
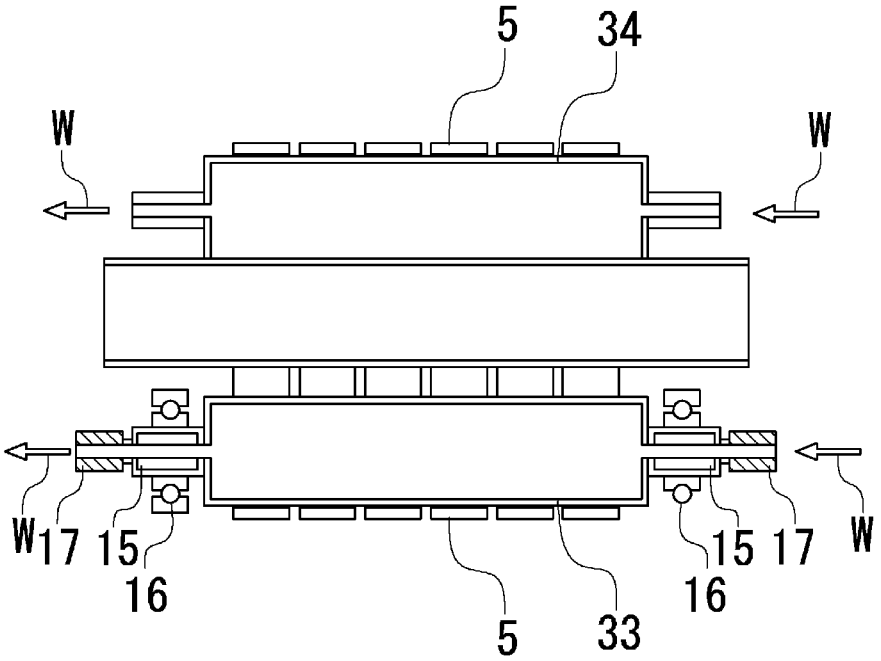
FIG. 6 is a schematic cross-sectional view from an upper structure side in a direction of an arrow Y of FIG. 5.

In addition, the cooling water also flows into the fixed semicylinder 34 and the fixed semicylinder 37 or even the upper pressing portion 35 and the lower pressing portion 38, thereby further increasing the cooling efficiency. In addition, for reference, FIG. 6 is a schematic cross-sectional view from an upper structure side in a direction of an arrow Y of FIG. 5, and shows the flow of cooling water inside the device.

Fourth Embodiment

Hereinafter, a fourth embodiment of the present invention will be described.

Figure 7:
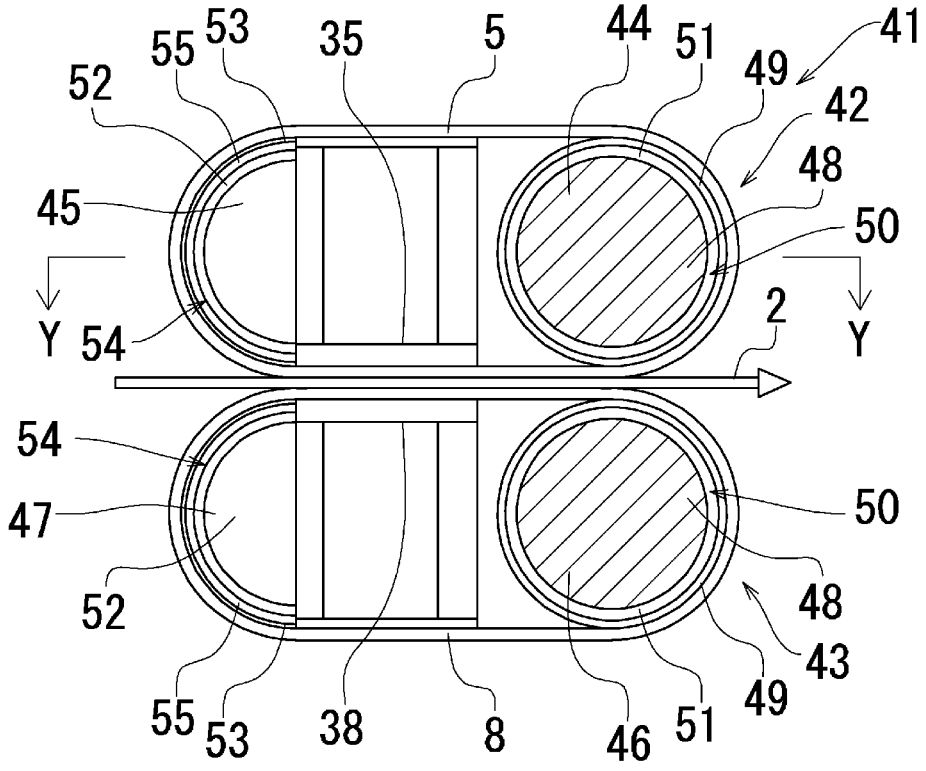
FIG. 7 is a schematic view showing a structure of a fourth embodiment of the present invention.

FIG. 7 is a schematic view showing a structure of the fourth embodiment of the present invention.

In FIG. 7, a coiling tension applying device 41 according to the fourth embodiment of the present invention is described. The coiling tension applying device 41 includes an upper structure 42 disposed above the band sheet 2 and a lower structure 43 disposed below the band sheet 2. Further, in FIG. 7, the same components as the above-described first and third embodiments of the present invention are denoted by the same reference numerals and description thereof will be omitted. Hereinafter, components of the fourth embodiment different from the components of the first and third embodiments will be described.

The upper structure 42 has a cooling roll 44 that allows the one or more upper belts 5 to be stretched in an elliptical shape and a fixed semicylinder 45. Further, the upper structure 42 has the upper pressing portion 35 adjacent to the fixed semicylinder 45.

In addition, the lower structure 43 has a cooling roll 46 that allows the one or more lower belts 8 to be stretched and a fixed semicylinder 47. Further, the lower structure 43 has the lower pressing portion 38 adjacent to the fixed semicylinder 47.

In the coiling tension applying device 41, structures of the cooling roll 44, the cooling roll 46, the fixed semicylinder 45, and fixed semicylinder 47 differ from those of the above-described third embodiment.

The cooling roll 44 and the cooling roll 46 have a double cylindrical structure composed of an inner cylinder portion 48 integrated with a rotary shaft and an outer cylinder portion 49 formed on the outer side of the inner cylinder portion 48. Further, a space 50 is formed between the inner cylinder portion 48 and the outer cylinder portion 49, and the cooling water 51 flows into this space. The outer cylinder portion 49 is made of steel having a plate thickness of 1 to 3 mm.

In addition, the cross-sectional area of the space 50 is 2.5 to 5.0 times the cross-sectional area of a pipe on a side of the cooling water 51 entering each cooling roll and the cross-sectional area of a pipe on an outlet side of the water from each cooling roll.

The fixed semicylinder 45 and the fixed semicylinder 47 have a double cylindrical structure composed of an inner semicylinder portion 52 and an outer semicylinder portion 53 formed on the outer side of the inner semicylinder portion 52. Further, a space 54 is formed between the inner semicylinder portion 52 and the outer semicylinder portion 53, and the cooling water 55 flows into this space. The outer semicylinder portion 53 is made of steel having a plate thickness of 1 to 3 mm.

As described above, in the fourth embodiment of the present invention, by employing a double cylindrical structure in the cooling roll 44, the cooling roll 45, the fixed semicylinder 45, and the fixed semicylinder 47, the cooling water flows closer to the outer peripheral surface with which each belt is brought into contact, thereby further increasing the cooling efficiency. Further, since the space in which the cooling water flows becomes small, an amount of the cooling water can be reduced and efficient heat removal can be realized.

Figure 8:
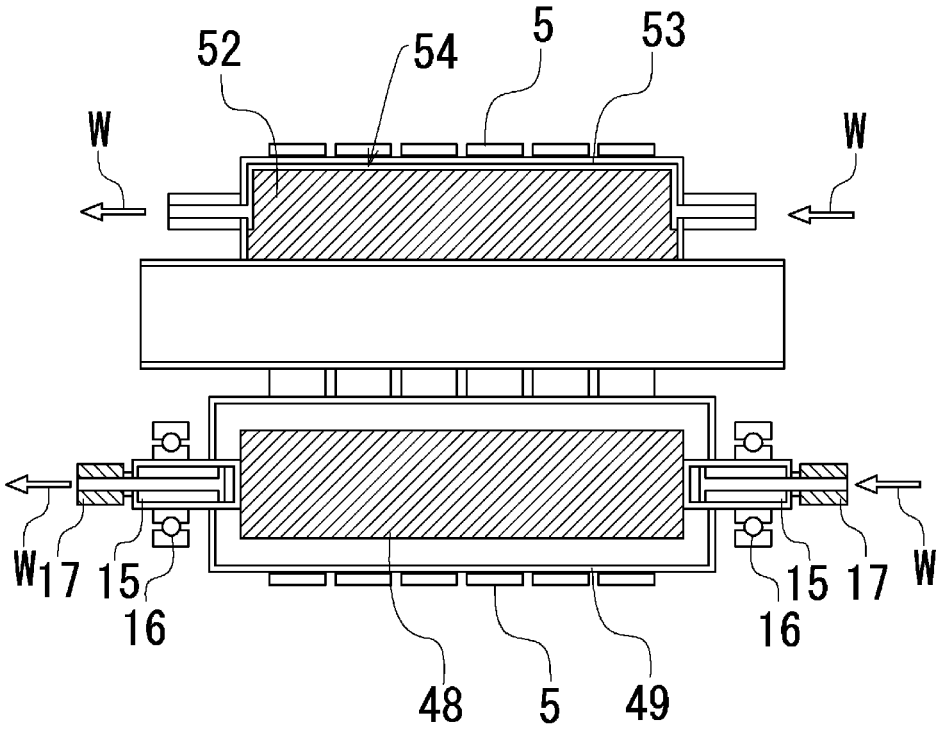
FIG. 8 is a schematic cross-sectional view from an upper structure in a direction of an arrow Y of FIG. 7.

In addition, since each of the outer cylinder portion 49 and the outer semicylinder portion 53 has a thin plate thickness of 1 to 3 mm, the heat from the inner surface 12 of each belt is easy to be transferred and each of the outer cylinder portion 49 and the outer semicylinder portion 53 has a structure having a high thermal conductivity to the cooling water therein. In addition, for reference, FIG. 8 is a schematic cross-sectional view from an upper structure in a direction of an arrow Y of FIG. 7, and shows the flow of cooling water inside the device.

Figure 9:
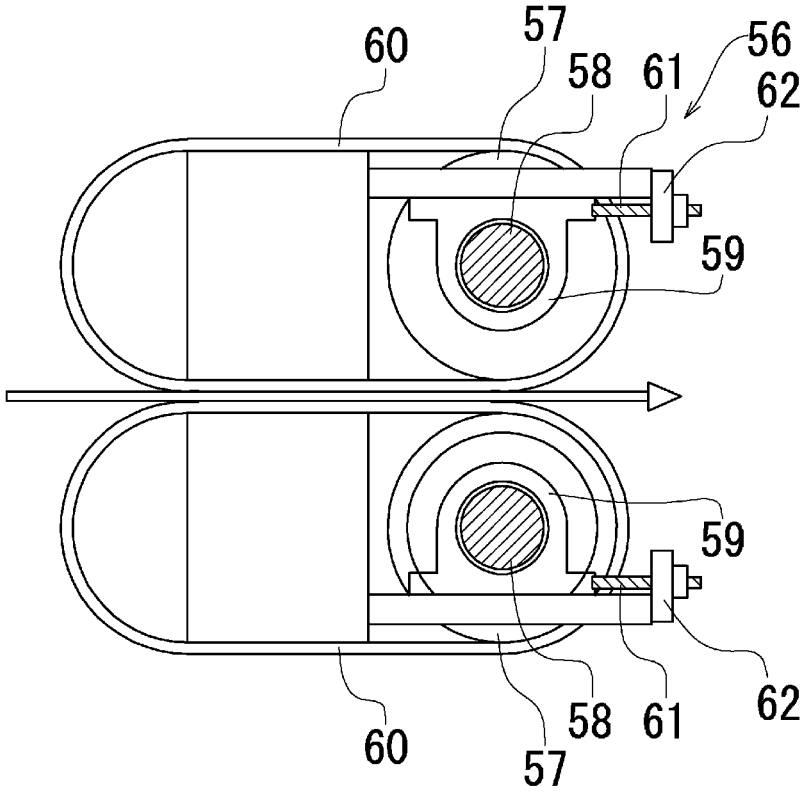
FIG. 9 is a schematic view showing a structure of a fifth embodiment of the present invention.
Figure 10:
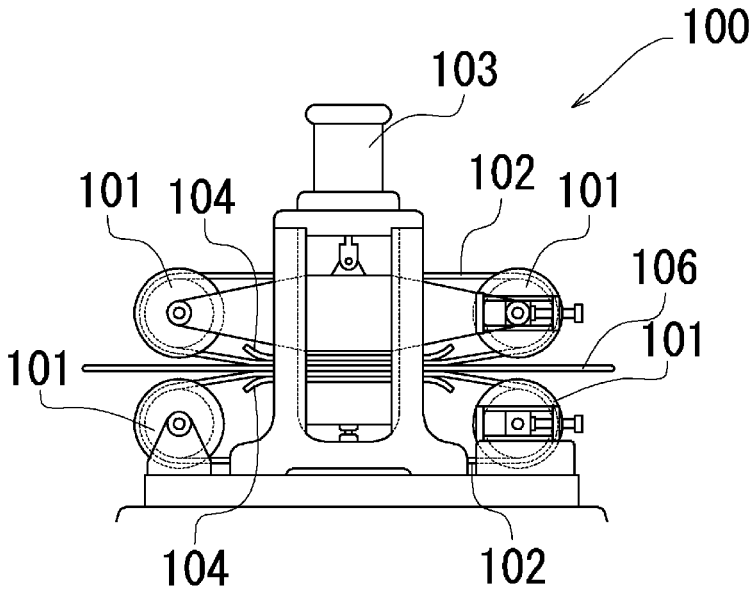
FIG. 10A is a schematic view showing a conventional coiling tension applying device using a pulley.
FIG. 10B is a schematic view showing a coiling tension applying device using an elliptical pressure applying body.
Figure 10:
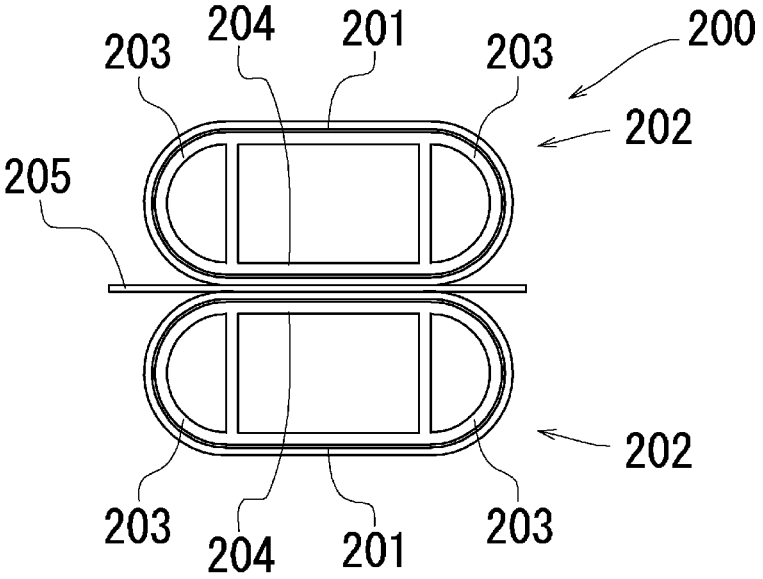

As the embodiment of the present invention, a fifth embodiment shown in FIG. 9 can be also employed.

In a coiling tension applying device 56 shown in FIG. 9, a bearing 59 is mounted on a rotary shaft 58 of a cooling roll 57. A position adjusting rod 61 provided in a direction substantially parallel to a longitudinal direction of a belt 60 is mounted on the bearing 59, and the position of each of the bearing 59 and the cooling roll 57 can be changed by a position adjusting screw 62 in the left and right direction shown in FIG. 9.

The degree of tension of the belt 60 can be adjusted by changing the position of the cooling roll 57 by the position adjusting screw 62. That is, the cooling roll 57 can be moved in accordance with the extension and contraction of the belt 60 accompanying the temperature rise, so that the belt 60 can be stretched to have a proper degree of tension.

As described above, the slit band sheet coiling tension applying device according to the present invention is excellent in durability and improved in convenience in a slitter line of a metal band sheet.

More specifically, in the slit band sheet coiling tension applying device according to the present invention, the cooling efficiency of the belt is remarkably improved, by which it is possible to perform a continuous operation over an extended time in the slitter line of the metal band sheet so that the durability is excellent and the convenience is improved.

Descriptions of reference numerals

| | |
|---|---|
| 1: coiling tension applying device | 2: band sheet |
| 3: upper structure | 4: lower structure |
| 5: upper belt | 6: cooling roll |
| 7: upper pressing portion | 8: lower belt |
| 9: cooling roll | 10: lower pressing portion |
| 11: outer surface | 12: inner surface |
| 14: cooling water | 15: rotary shaft |
| 16: bearing | 17: rotary joint |
| 18: coiling tension applying device | 19: upper structure |
| 20: lower structure | 21: cooling roll |
| 22: cooling roll | 23: inner cylinder portion |
| 24: outer cylinder portion | 25: space |
| 26: cooling water | 27: rotary shaft |
| 28: bearing | 29: rotary joint |
| 30: coiling tension applying device | 31: upper structure |
| 32: lower structure | 33: cooling roll |
| 34: fixed semicylinder | 35: upper pressing portion |
| 36: cooling roll | 37: fixed semicylinder |
| 38: lower pressing portion | 39: cooling water |
| 40: cooling water | 41: coiling tension applying device |
| 42: upper structure | 43: lower structure |
| 44: cooling roll | 45: fixed semicylinder |
| 46: cooling roll | 47: fixed semicylinder |
| 48: inner cylinder portion | 49: outer cylinder portion |
| 50: space | 51: cooling water |
| 52: inner semicylinder portion | 53: outer semicylinder portion |
| 54: space | 55: cooling water |
| 56: coiling tension applying device | 57: cooling roll |
| 58: rotary shaft | 59: bearing |
| 60: belt | 61: position adjusting rod |
| 62: position adjusting screw | |

The invention claimed is:

1. A device for applying coiling-tension to a slit band sheet, comprising:

a first stretched portion having a first cooling roll that is constructed to be independently rotatable, has a cylindrical shape, and has coolant inside the first cooling roll;

one or more first belts made of materials having different coefficients of friction, being in contact with the first stretched portion at a side thereof having a smaller coefficient of friction than that of an opposite side thereof, and being stretched in a ring shape to be freely rotatable;

a first pressing portion, being in contact with the side of the one or more first belts, having the smaller coefficient of friction, in a predetermined length;

a second stretched portion constructed to be positioned to face the first stretched portion and to have a second cooling roll that is constructed to be independently rotatable, has a cylindrical shape, and has coolant inside the second cooling roll;

one or more second belts made of materials having different coefficients of friction, being in contact with the second stretched portion at a side thereof having a smaller coefficient of friction than that of an opposite side thereof, and being stretched in a ring shape to be freely rotatable; and a second pressing portion, constructed to be positioned to face the first pressing portion and to be close to the first pressing portion, and to be in contact with the side of the one or more second belts having the smaller coefficient of friction in a predetermined length, wherein each of the first cooling roll and the second cooling roll has an inner cylinder on a side of a center shaft and an outer cylinder substantially surrounding the inner cylinder, wherein the coolant is circulated in a space formed between the inner cylinder and the outer cylinder, wherein the inner cylinder is integrated with a rotary shaft such that the inner cylinder is of solid construction, wherein a cross-sectional area of the space is 2.5 to 5.0 times a cross-sectional area of a pipe on an inlet side of the coolant entering into each of the first and second cooling rolls, and wherein the cross-sectional area of the space is 2.5 to 5.0 times a cross-sectional area of a pipe on an outlet side of the coolant exiting from each of the first and second cooling rolls.

2. The device as claimed in claim 1, wherein the one or more first belts are disposed side by side with each other in the first stretched portion having the same intervals between each adjacent one or more first belts, and the one or more second belts are disposed side by side with each other in the second stretched portion and having the same intervals between each adjacent one or more second belts.

3. The device as claimed in claim 1, wherein the coolant circulated between the inner cylinders and the outer cylinders is cooling water.

4. The device as claimed in claim 1, wherein the outer cylinders has a thickness of 3 mm or less.

5. The device as claimed in claim 1, wherein the first cooling roll and the second cooling roll are disposed so as to advance a slitter line in a direction in which a the slit band sheet is conveyed.

6. The device as claimed in claim 1, comprising a couple of the first cooling rolls, disposed at both sides of the first stretched portion, and a couple of the second cooling rolls, disposed at both sides of the second stretched portion.

7. The device as claimed in claim 1, wherein the first stretched portion is provided with the first cooling roll disposed at one end thereof and a first belt reversing portion disposed at the other end thereof, the first belt reversing portion having a semi-cylindrical cross-section in a longitudinal direction, and the second stretched portion is provided with the second cooling roll disposed at one end thereof and a second belt reversing portion disposed at the other end thereof, the second belt reversing portion having a semi-cylindrical cross-section in a longitudinal direction.

* * * * *